US005609103A

United States Patent [19]

Stephan et al.

[11] Patent Number: 5,609,103

[45] Date of Patent: Mar. 11, 1997

[54] SHEET-METAL GUIDE FOR A SHEET TURNING DEVICE

[75] Inventors: Günter Stephan, Wiesloch-Baiertal; Michael Szeidl, Bammental, both of Germany

[73] Assignee: Heidelberger Druckmaschinen AG, Heidelberg, Germany

[21] Appl. No.: 539,843

[22] Filed: Oct. 6, 1995

[30] Foreign Application Priority Data

Oct. 6, 1994 [DE] Germany ..... 94 16 106.2

[51] Int. Cl.[6] ..... B41F 5/02; B65H 29/24

[52] U.S. Cl. ..... 101/230; 271/195; 101/411

[58] Field of Search ..... 101/230, 231, 101/232, 408, 409, 411; 271/196, 204, 195

[56] References Cited

U.S. PATENT DOCUMENTS

| | | | |
|---|---|---|---|
| 4,099,463 | 7/1978 | Zimmermann et al. | 101/230 |
| 4,165,689 | 8/1979 | Giuiuzza | 101/232 |
| 4,170,927 | 10/1979 | van der Meulen | 271/196 |
| 4,203,361 | 5/1980 | Pollich | 271/204 |
| 4,572,071 | 2/1986 | Cappel et al. | 101/231 |
| 4,688,784 | 8/1987 | Wirz | 271/195 |
| 4,930,414 | 6/1990 | Wirz | 101/230 |
| 5,086,698 | 2/1992 | Wirz | 101/409 |
| 5,134,938 | 8/1992 | Büsse et al. | 101/230 |
| 5,411,251 | 5/1995 | Schmid et al. | 271/204 |

FOREIGN PATENT DOCUMENTS 4140762 6/1993 Germany .

*Primary Examiner*—Eugene H. Eickholt

*Attorney, Agent, or Firm*—Herbert L. Lerner; Laurence A. Greenberg

[57] ABSTRACT

A sheet turning device including a turning drum for turning over stock or a print carrier received in an ideal path of motion from a storage drum in a recto/verso or first-form and perfector printing process is in combination with a sheet-metal guide having a surface member formed with air outlet openings for floatingly guiding the stock or the print carrier, the surface member being disposed so as to face a printed side of the stock or the print carrier below the turning drum and extending in a direction towards the storage drum.

7 Claims, 2 Drawing Sheets

SHEET-METAL GUIDE FOR A SHEET TURNING DEVICE

BACKGROUND OF THE INVENTION

Field of the Invention

The invention relates to a sheet-metal guide for a sheet turning device, with which, more particularly, stock or a print carrier is turned over for recto/verso or first-form and perfector printing and is accordingly floatingly guided by the sheet-metal guide which has air outlet openings formed therein.

During the passage of the stock or print carrier through the printing press, it is transferred from one drum to another and thereby fed to one or more impression cylinders, by means of which printing is applied to the stock or print carrier. Along the way, the stock or print carriers must often be additionally guided, for which purpose sheet-metal guides are used which are often provided with air outlet openings for holding the printed stock or print carriers in a floating or suspended manner so as to prevent smearing.

A sheet-metal guide of the general type referred to at the introduction hereto has become known heretofore from the Published, Non-Examined German Patent Application DE-OS 41 40 762. In this publication, the stock or print carrier, upon being turned, is guided with the nonprinted side thereof by a sheet-metal guide provided with air outlet openings and disposed below the impression cylinder, until the stock or print carrier undergoes a reversal of motion after it has been engaged by the grippers of the turning cylinder. The guidance of the stock or print carrier with this heretofore known device results, however, in an erratic travel of the stock or print material and a fluttering thereof.

SUMMARY OF THE INVENTION

It is accordingly an object of the invention to provide a sheet-metal guide for a sheet turning device whereby a sheet to be turned is guided smoothly and without fluttering along an ideal path of motion.

With the foregoing and other objects in view, there is provided, in accordance with the invention, in combination, a sheet turning device including a turning drum for turning over stock or a print carrier received in an ideal path of motion from a storage drum in a recto/verso or first-form and perfector printing process, and a sheet-metal guide, the sheet-metal guide comprising a surface member formed with air outlet openings for floatingly guiding the stock or the print carrier, the surface member being disposed so as to face a printed side of the stock or the print carrier below the turning drum and extending in a direction towards the storage drum.

In accordance with another feature of the invention, the surface member of the sheet-metal guide has a surface formed with a substantially S-shaped curvature.

In accordance with a further feature of the invention, the surface member has a substantially straight or planar surface.

In accordance with an added feature of the invention, the stock or print carrier has an ideal path of motion, and the surface member of the sheet-metal guide extends parallel to the ideal path of motion of the stock or print carrier.

In accordance with a concomitant feature of the invention, the air outlet openings are oriented so that air emerging therefrom is directed predominantly in the ideal direction of motion of the stock or the print carrier and is additionally directed symmetrically from the middle of the stock or print carrier towards respective side edges thereof.

An advantage of the sheet-metal guide according to the invention is that the stock or print carrier to be turned over are guided without contact by the freshly printed side thereof and thus calmly, without fluttering and tautly describe the ideal path of motion. In recto or first form printing, as well, the sheet-metal guide performs a better guidance of the stock or the print carrier, especially in the case of stock or print carriers which rest poorly on the turning drum.

The sheet-metal guide may be embodied in various forms. It may have a surface curved substantially in the form of an S, or it may be embodied as essentially straight or planar in form. It is also possible for the sheet-metal guide surface to be formed so that it extends parallel to the desired ideal path of motion of the stock or print carrier.

For good guidance of the stock or print carrier, it is expedient that the air outlet openings be oriented so that the air emerging therefrom is directed predominantly in the direction of motion of the stock or print carrier, and is additionally outwardly directed symmetrically from the middle of the stock or print carrier towards the respective side edges thereof.

Other features which are considered as characteristic for the invention are set forth in the appended claims.

Although the invention is illustrated and described herein as embodied in a sheet-metal guide for a sheet turning device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
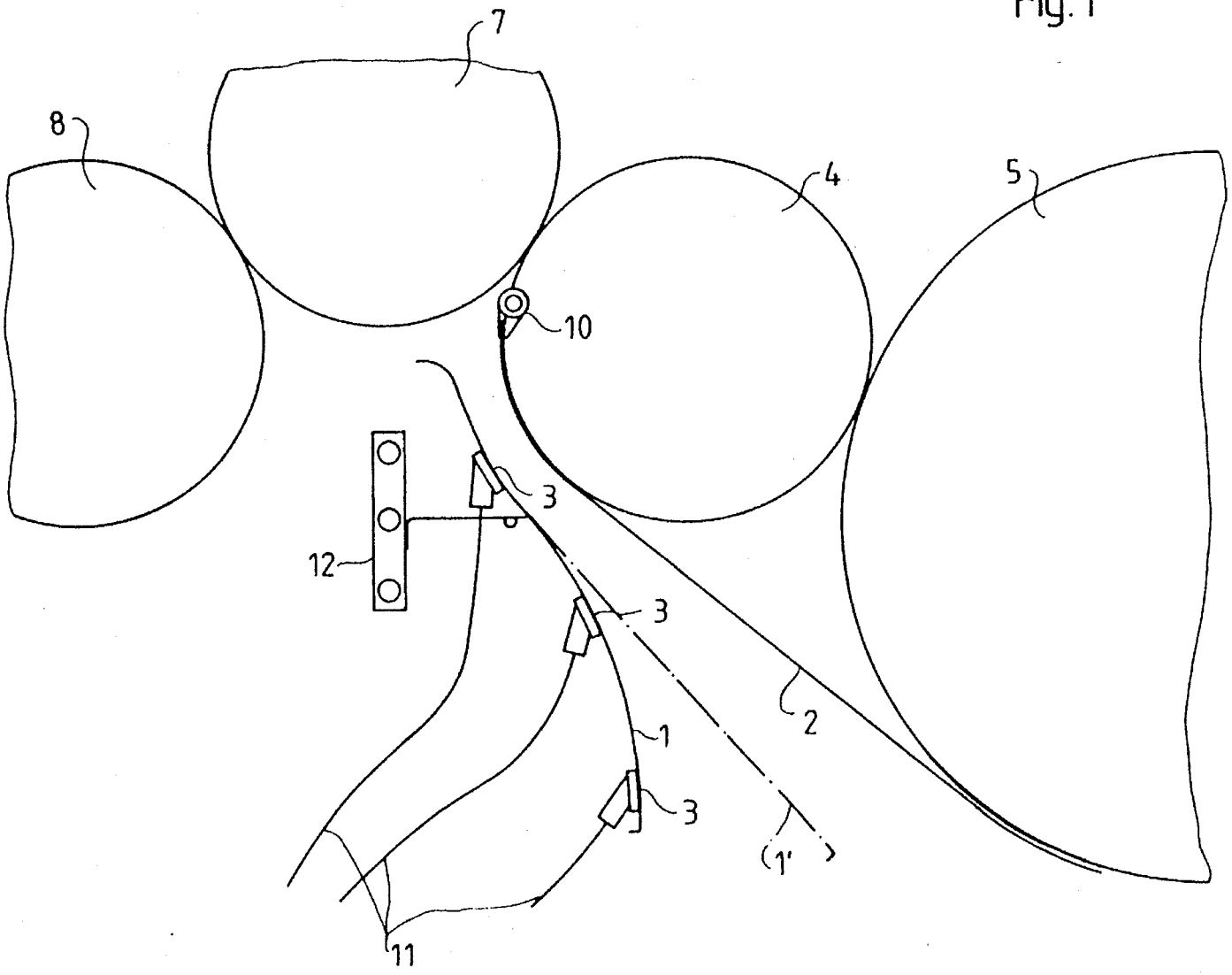
FIG. 1 is a diagrammatic, fragmentary side elevational view of a printing press wherein a sheet-metal guide for a sheet turning device according to the invention is disposed.

Referring now to the drawing and, first, particularly to FIG. 1 thereof, there is shown therein how a sheet-metal guide 1 or 1' is disposed in a printing press so that it is located below a turning drum 4 and extends in a direction towards a storage drum 5.

Figure 3:
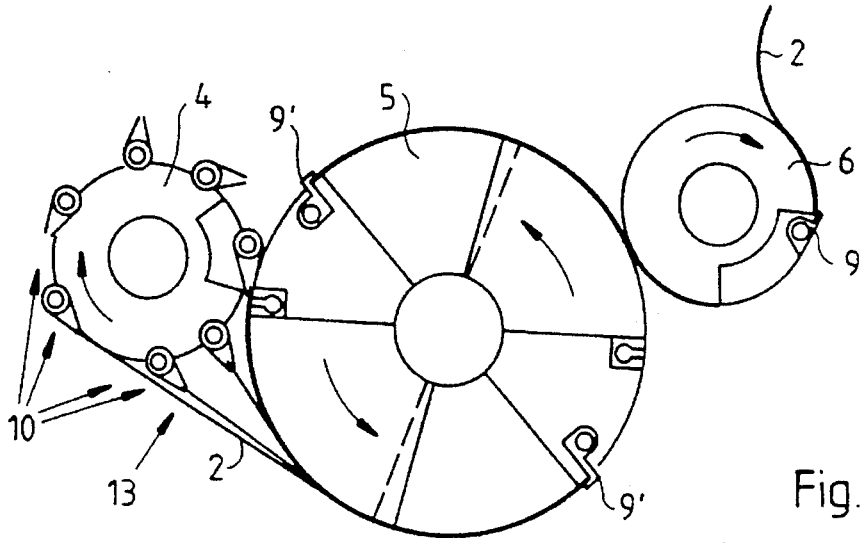
FIG. 3 is a diagrammatic, side elevational view of a sheet turning device constructed in accordance with the principles of the Heidelberger Druckmaschinen A. G.

In the interest of clarity, the principles of operation of a Heidelberger turning device will first be explained herein with reference to FIG. 3. A first transfer drum 6 with grippers 9 receives the stock or print carrier 2 and passes it on to the storage drum 5 along a line of contact with the storage drum 5, grippers 9' of the storage drum 5 receiving or taking over a leading edge of the stock or print carrier 2, and the grippers 9 of the transfer drum 6 releasing the stock or print carrier 2. If the press is operating in recto or first-form printing, the stock or print carrier 2 is transported on the storage drum 5 up to the line of contact thereof with the turning drum 4, where it is passed on to pincers grippers 10 in the manner just described. Conversely, if the press is operating in verso or perfector printing, no transfer of the stock or print carrier 2 takes place at the line of contact between the storage drum 5 and the turning drum 4; instead, the grippers 9' of the storage drum 5 remain closed and transport the stock or print carrier 2 onwardly until the pincers grippers 10 have engaged or gripped the trailing end of the stock or print carrier 2 and transported the stock 2 to the position 13, where a reversal of motion takes place wherein the grippers 9' release what was previously the leading edge and now is the trailing edge of the stock or print carrier 2. At that instant of time, the stock or print carrier 2 floats freely, so that fluttering or smearing can easily occur. To prevent this from happening, as shown in FIG. 1, a sheet-metal guide 1 or 1' is provided, which is formed with air outlet openings 3 disposed in rows extending at right angles to the plane of the drawing, the air outlet openings 3 being supplied with compressed air by means of air inlet lines 11. In this way, the stock or print carrier 2 is acted upon by compressed air so that it slides above the sheet-metal guide 1 or 1' without touching it. Consequently, at a given distance from the sheet-metal guide 1 or 1' a compressive force is formed or, in the other direction, a suction force is formed, which result in a stable spacing wherein the stock or print carrier 2 is guided without smearing. After the stock or print carrier 2 has been turned, it is fed to the impression cylinder 7 to be printed in verso or perfecting and, thereafter, a second transfer drum 8 assures that the printed stock or print carrier 2 is transferred to the next printing unit. In FIG. 1, an alternative embodiment of the sheet-metal guide 1' is shown in phantom. Various forms of the surface of the sheet-metal guide 1 or 1' are possible; they depend upon the respective given conditions or characteristics of a particular press and upon the stock or print carrier 2 which are preferentially printed on the particular press. A bracket or support 12 which connects the sheet-metal guide 1 or 1' to the press housing or frame is also provided.

Figure 2:
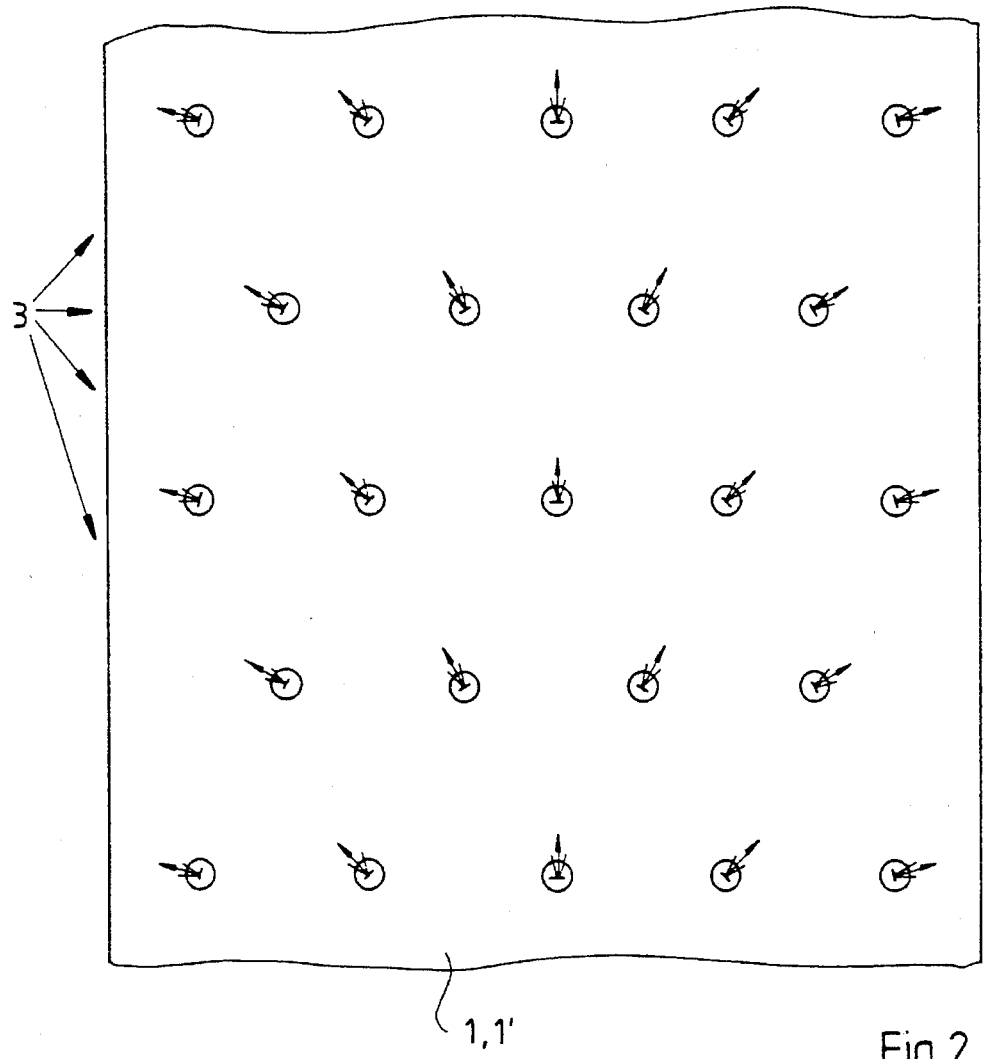
FIG. 2 is a top plan view of the sheet-metal guide showing the orientation of air outlet openings formed therein.

FIG. 2 shows a detail of the surface of a sheet-metal guide 1 or 1' from which the arrangement of the air outlet openings 3 can be readily seen. A significant feature shown in this view is that the air outlet openings 3 are oriented in a manner that the air flows predominantly in the direction of motion of the stock or print carrier 2. In order to tauten the sheets, an air flow is additionally generated which is directed outwardly from the middle of the stock or print carrier 2 symmetrically to the side edges thereof.

We claim:

1. In combination with a sheet-fed printing machine having a storage drum and a sheet turning device including a turning drum for turning over stock or a print carrier for recto/verso or first-form and perfector printing in between the storage drum and the turning drum, and wherein an ideal path of motion for the stock or print carrier is defined between the storage drum and the turning drum, a sheet-metal guide, the sheet-metal guide comprising a surface member formed with air outlet openings for floatingly guiding the stock or the print carrier, said surface member being disposed so as to face a printed side of the stock or the print carrier below the turning drum and extending in a direction towards the storage drum, and said surface member extending parallel to the ideal path of motion of the stock or print carrier.

2. Sheet-metal guide according to claim 1, wherein said surface member of said sheet-metal guide has a surface formed with a substantially S-shaped curvature.

3. Sheet-metal guide according to claim 1, wherein said surface member has a substantially straight or planar surface.

4. In combination, a sheet turning device including a turning drum for turning over stock or a print carrier received in an ideal path of motion from a storage drum in a recto/verso or first-form and perfector printing process, and a sheet-metal guide, the sheet-metal guide comprising a surface member formed with air outlet openings for floatingly guiding the stock or the print carrier, said surface member being disposed so as to face a printed side of the stock or the print carrier below the turning drum and extending in a direction towards the storage drum, said air outlet openings are oriented so that air emerging therefrom is directed predominantly in said ideal direction of motion of the stock or the print carrier and is additionally directed symmetrically from the middle of the stock or print carrier towards respective side edges thereof.

5. Sheet-metal guide according to claim 4, wherein said surface member of said sheet-metal guide has a surface formed with a substantially S-shaped curvature.

6. Sheet-metal guide according to claim 4, wherein said surface member has a substantially straight or planar surface.

7. Sheet-metal guide according to claim 4, wherein the stock or print carrier has an ideal path of motion, and said surface member of said sheet-metal guide extends parallel to said ideal path of motion of the stock or print carrier.

* * * * *